US009648429B2

(12) United States Patent
Higgins et al.

(10) Patent No.: US 9,648,429 B2
(45) Date of Patent: May 9, 2017

(54) HEARING ASSISTANCE DEVICE WITH IMPROVED MICROPHONE PROTECTION

(71) Applicant: Starkey Laboratories, Inc., Eden Prairie, MN (US)

(72) Inventors: Sidney A. Higgins, Maple Grove, MN (US); Gary Zajicek, Waconia, MN (US); Toto Saykeo, Eden Prairie, MN (US); Jerome C. Ruzicka, Plymouth, MN (US); Janet Richardson, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/085,031

(22) Filed: Nov. 20, 2013

(65) Prior Publication Data

US 2014/0334651 A1 Nov. 13, 2014

Related U.S. Application Data

(60) Provisional application No. 61/822,182, filed on May 10, 2013.

(51) Int. Cl.
*H04R 25/00* (2006.01)

(52) U.S. Cl.
CPC ..... *H04R 25/602* (2013.01); *H04R 25/654* (2013.01); *H04R 25/604* (2013.01); *H04R 2225/023* (2013.01)

(58) Field of Classification Search
CPC .... H04R 25/602; H04R 25/65; H04R 25/604; H04R 25/658; H04R 25/654;
(Continued)

(56) References Cited

U.S. PATENT DOCUMENTS 5,201,008 A * 4/1993 Arndt et al. ..... 381/323
7,127,077 B2 10/2006 Hall et al.
(Continued)

FOREIGN PATENT DOCUMENTS

DE 3736591 A1 11/1988
EP 1246507 A1 10/2002
WO WO-2009083007 A2 7/2009

OTHER PUBLICATIONS

"European Application Serial No. 14167395.4, Extended European Search Report mailed Aug. 6, 2014", 7 pgs.
(Continued)

*Primary Examiner* — Paul S Kim
*Assistant Examiner* — Norman Yu
(74) *Attorney, Agent, or Firm* — Schwegman, Lundberg & Woessner, P.A.

(57) ABSTRACT

Disclosed herein, among other things, are methods and apparatus for improved microphone protection for hearing assistance devices. One aspect of the present subject matter includes a hearing assistance device, such as a completely-in-the-canal (CIC) type hearing aid, that includes a battery door with a microphone slit and a battery contact including a microphone port. In various embodiments, the microphone slit and the microphone port are configured to create a nonlinear acoustic path to a microphone of the hearing assistance device. In various embodiments, the acoustic path is configured to prevent earwax from blocking and/or damaging the microphone, such as during insertion, removal or cleaning of the hearing assistance device.

15 Claims, 4 Drawing Sheets

(58) Field of Classification Search
CPC ..... H04R 2225/61; H04R 25/60; H04R 2225/023; H04R 2460/17; H04R 25/02; H04R 19/016; H04R 1/02; H04R 11/04; H04R 1/10; H04R 1/1008; H01M 2220/30; H01M 2/1022
USPC ..... 381/322–323, 328, 324, 325, 111, 23.1, 381/312, 375, 87; 220/4.02; 455/90.3
See application file for complete search history.

(56) References Cited

U.S. PATENT DOCUMENTS

| | | | | |
|---|---|---|---|---|
| 7,221,769 | B1 * | 5/2007 | Jorgensen | 381/328 |
| 7,792,315 | B2 | 9/2010 | Mullenborn et al. | |
| 8,284,973 | B2 | 10/2012 | Gabathuler et al. | |
| 2005/0232453 | A1 * | 10/2005 | Fideler | 381/322 |
| 2010/0158294 | A1 * | 6/2010 | Helgeson | H04R 25/602 381/323 |
| 2010/0322452 | A1 | 12/2010 | Ladabaum et al. | |

OTHER PUBLICATIONS

"European Application Serial No. 14167395.4, Communication Pursuant to Article 94(3) EPC mailed Jun. 29, 2016", 6 pgs.

* cited by examiner

HEARING ASSISTANCE DEVICE WITH IMPROVED MICROPHONE PROTECTION

CLAIM FOR PRIORITY AND INCORPORATION BY REFERENCE

This application claims the benefit under 35 U.S.C. §119 (e) of U.S. Provisional Application No. 61/822,182, filed 10 May 2013, the disclosure of which is incorporated herein by reference in its entirety.

TECHNICAL FIELD

This document relates generally to hearing assistance systems and more particularly to methods and apparatus for improved microphone protection for hearing assistance devices.

BACKGROUND

Modern hearing assistance devices, such as hearing aids, are electronic instruments worn in or around the ear that compensate for hearing losses by specially amplifying sound. Hearing aids typically include an enclosure or housing with one or more openings for a microphone that senses sound, hearing assistance device electronics including processing electronics, and a speaker or receiver to play processed sound for the wearer. When a completely-in-the-canal (CIC) type hearing aid is inserted and removed from the wearer's ear, wax or debris is often pushed or migrates into the microphone openings causing blockage of the acoustic inlet. If not regularly removed, such blockage can render the device inoperable and sometimes beyond repair.

Accordingly, there is a need in the art for improved systems and methods for microphone protection for hearing assistance devices.

SUMMARY

Disclosed herein, among other things, are methods and apparatus for improved microphone protection for hearing assistance devices. One aspect of the present subject matter includes a hearing assistance device, such as a completely-in-the-canal (CIC) type hearing aid, that includes a battery door with a microphone slit and a battery contact including a microphone port. In various embodiments, the microphone slit and the microphone port are configured to create a nonlinear acoustic path to a microphone of the hearing assistance device. In various embodiments, the acoustic path is configured to prevent earwax from blocking and/or damaging the microphone, such as during insertion, removal or cleaning of the hearing assistance device.

In one embodiment, a hearing assistance device includes a microphone, a battery door including a microphone slit, and a battery contact including a microphone port. The microphone slit and the microphone port are configured to create an acoustic path to the microphone. The acoustic path includes an approximately 90 degree turn.

In one embodiment, a hearing assistance device includes a microphone, a battery door including a microphone opening, a battery contact configured to be an acoustic barrier and including a microphone port for the microphone, and an acoustic path between the microphone opening and the microphone. The acoustic path is formed by the battery door and the battery contact when the battery door is closed.

In one embodiment, a hearing assistance device includes a shell customized to mate with a wearer's ear canal, a faceplate attached to the shell, and a faceplate module attached to the faceplate. The faceplate module includes a microphone opening, a microphone, and an acoustic path between the microphone opening and the microphone. The acoustic path includes two approximately 90 degree turns.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
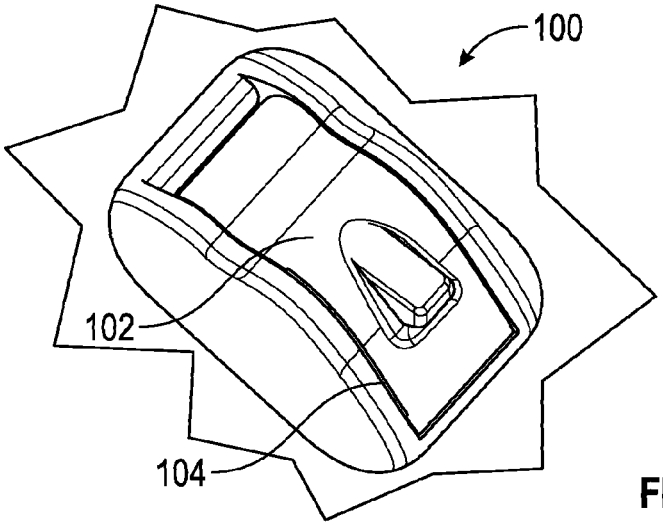
FIG. 1A illustrates portions of a battery door assembly for a hearing assistance device, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Hearing aids typically include an enclosure or housing with one or more openings for a microphone that senses sound, hearing assistance device electronics including processing electronics, and a speaker or receiver to play processed sound for the hearing aid wearer. When a completely-in-the-canal (CIC) type hearing aid is inserted and removed from the wearer's ear, wax is often pushed or migrates into the microphone openings causing blockage of the acoustic inlet. This blockage if not regularly removed can render the device inoperable and sometimes un-repairable.

Previously, removable wax guards and coatings were used to prevent wax build up and ingress. However, these wax guards are tiny and difficult to clean. If removed, the guards are easy to damage or misplace. The coatings can make wax easier to remove, but does not stop it from accumulating and damaging the microphone. Accordingly, there is a need in the art for improved systems and methods for microphone protection for hearing assistance devices.

Disclosed herein, among other things, are methods and apparatus for improved microphone protection for hearing assistance devices. One aspect of the present subject matter includes a CIC type hearing assistance device for a wearer including a battery door with a microphone slit and a battery contact including a microphone port. The microphone slit and the microphone port are configured to create a nonlinear acoustic path to a device microphone, in various embodiments. In one embodiment, the microphone slit and the microphone port are configured to create an approximately 90 degree acoustic path to a device microphone. Other angles can be used without departing from the scope of the present subject matter, to create a torturous acoustic path to the microphone thus impeding the ingress of wax and other debris. According to various embodiments, the acoustic path is configured to prevent wax from entering during insertion, removal or cleaning of the hearing assistance device.

The present subject matter provides a hearing assistance device with a faceplate assembly that makes blockage of the acoustic inlet less likely to occur, makes wax build up easier to identify and remove, and increases the ease of daily maintenance for the wearer. In various embodiments, the present subject matter places a wax channel on the side of a battery door, making it easier to see and clean. In various embodiments, the present subject matter provides the wax channel with a larger surface area that, when compared to other solutions, enhances access and allow for longer time between cleanings in embodiments. According to various embodiments, a battery contact, which is configured to be an acoustic barrier and includes one or more acoustic ports, creates an acoustic channel including two approximately 90 degree turns that will stop most wax ingress. More or fewer turns can be used without departing from the scope of the present subject matter. The turns can have a greater or lesser angle than 90 degrees, in various embodiments. Various embodiments of the present subject matter include a side slit acoustic port in the battery door.

According to various embodiments, the battery door is coupled to a hinge pin of the hearing assistance device, which also includes centering bosses around the hinge pin to enhance hinge strength and locate the battery door so as to reduce drag on its opening and closing. Various embodiments of the present subject matter include split draft sidewalls on the battery door to create freer swing during its opening and closing. The battery contact is designed to create an acoustic barrier and port, in various embodiments. The battery door and the battery contact together create dual 90 degree turns in the acoustic path to the microphone, according to various embodiments. In various embodiments, acoustic port positioning is used to prevent any wax from entering during cleaning process.

The present subject matter is an improvement over previous solutions for a number of reasons. By placing the cleaning/acuminating element on the battery door, the wax protection feature is visible when the battery door is open. Thus, one does not need to remove the battery door to clean the wax protection feature, making it more user-friendly. The surface area of the wax protection feature available for collecting wax makes it easier to clean via fingers or a brush, in various embodiments. The present subject matter provides a port/cleaning mechanism without using additional component such as like a microphone hood or wax guard, making this an economical solution that does not have to increase the overall size of the hearing assistance device.

Figure 1B:
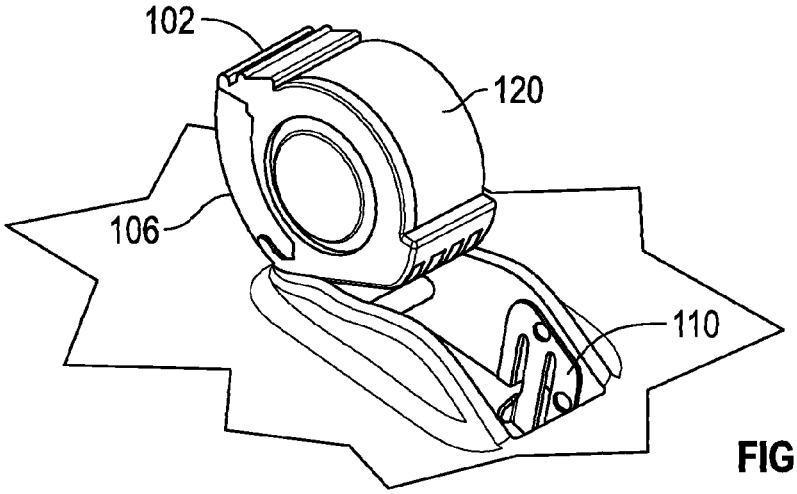
FIG. 1B illustrates the battery door assembly with the battery door open to show a battery and a battery contact, according to various embodiments of the present subject matter.
Figure 1C:
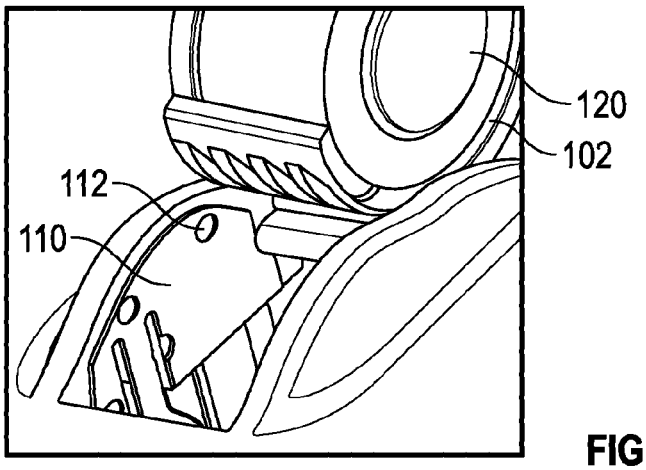
FIG. 1C illustrates another view of the battery door assembly with the battery door open.

FIGS. 1A-C illustrate various views of a battery door 102 and a battery contact 110 for a hearing assistance device, according to various embodiments of the present subject matter. FIG. 1A shows portions of a faceplate or battery door assembly 100 of the hearing assistance device. For the purpose of illustration, the faceplate 100 as shown represents portions of a faceplate module for a CIC type hearing aid. The faceplate module will be further discussed below, with reference to FIGS. 5A-5C.

The faceplate 100 includes a microphone opening 104 in the battery door 102. In the illustrated embodiment, the microphone opening 104 is a microphone slit vertically along the side of the battery door 102. Other configurations for the microphone opening 104 are possible without departing from the scope of the present subject matter. For example, the microphone opening 104 can be horizontal or at an angle from the horizontal or vertical direction, and can be in the body of the battery door 102 or at an end of the battery door 102 instead of along the side, in various embodiments. In this document, a "horizontal" direction refers to a direction parallel to the axis of rotation (swinging) of the battery door 102, and a "vertical direction" refers to a direction that is perpendicular to that axis.

FIG. 1B shows the faceplate 100 with the battery door 102 in an open position. A battery 120 of the hearing assistance device is affixed to the interior of the battery door 102. An acoustic recess 106 is formed in the battery door 102 in an overhang area that is over a microphone port when the battery door 102 is in the close position. The position of the recess 106 allows wax to be easily cleaned from it when the battery door 102 is in an open position. FIG. 1B also shows a battery contact 110 of the faceplate 100 that provides for electrical connection between the battery 120 and components of the hearing assistance device that are powered by the battery 120.

FIG. 1C shows another view (opposite side from FIG. B) of the faceplate 100 with the battery door 102 in the open position. The battery contact 100 as shown in FIG. 1C includes an acoustic port or microphone port 112.

In various embodiments, the battery contact 110 and the battery door 102 or 502 together create a non-linear acoustic path between the microphone opening 104 to the microphone. In various embodiments, this acoustic path includes at least one approximately 90 degree turn. For example, a sound entering through the microphone slit 104 makes an approximately 90 degree turn at the microphone port 112. In one embodiment, this acoustic path includes two approximately 90 degree turns. For example, a sound entering through the microphone slit 104 makes an approximately 90 degree turn to go through the acoustic recess 106 and another approximately 90 degree turn at the microphone port 112. In various embodiments, this acoustic path is a torturous acoustic path. For example, the torturous acoustic path may be formed by the relative locations and/or shapes of the microphone opening 104, acoustic recess 106, and microphone port 112.

Figure 2:
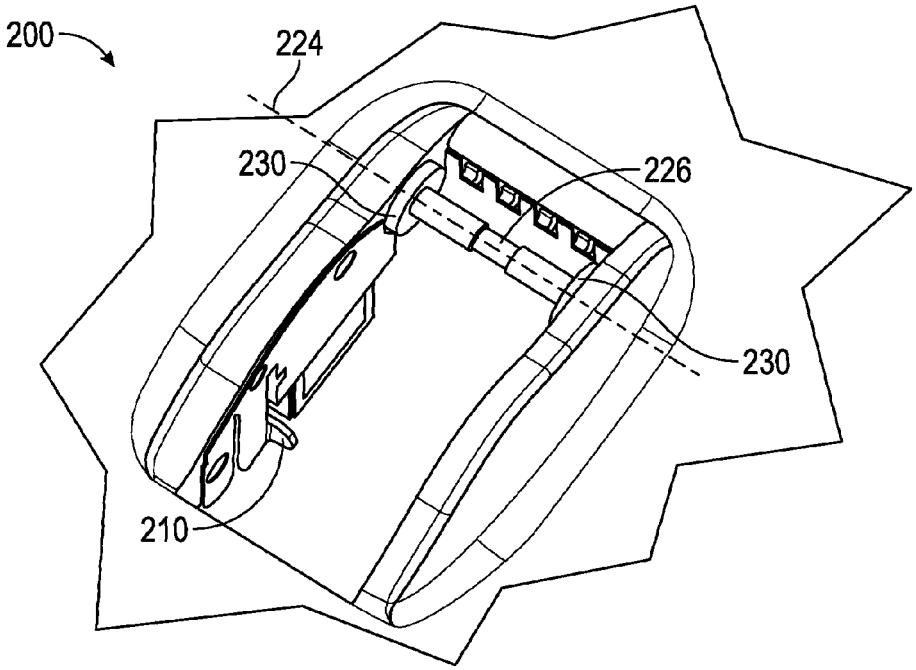
FIG. 2 illustrates portions of a battery door assembly (not showing the battery door) for a hearing assistance device, according to various embodiments of the present subject matter.

FIG. 2 illustrates a faceplate or battery door assembly 200 for a hearing assistance device, according to various embodiments of the present subject matter. Faceplate 200 includes a base or door frame structure for the battery door 102 and the battery door 102 (not shown in FIG. 2). The base structure includes a hinge pin 226 to which the battery door 102 is to be coupled and rotates around when being opened and closed, and centering bosses 230 around the hinge pin 226. In one embodiment, the battery door 102 includes split draft walls. The centering bosses 230 and the split draft walls keep drag to a minimum during the opening and closing of the battery door 102. In various embodiments, a vertical battery contact 210 with one or more microphones port permits repositioning of the microphone.

As illustrated in FIG. 2, the battery door 102 rotates (swings) around the hinge pin 226, which has an axis 224 (around which the battery door 102 rotates (swings)). In this document, a "horizontal" direction refers to a direction parallel to the axis 224, and a "vertical direction" refers to a direction that is perpendicular to the axis 224.

Figure 3:
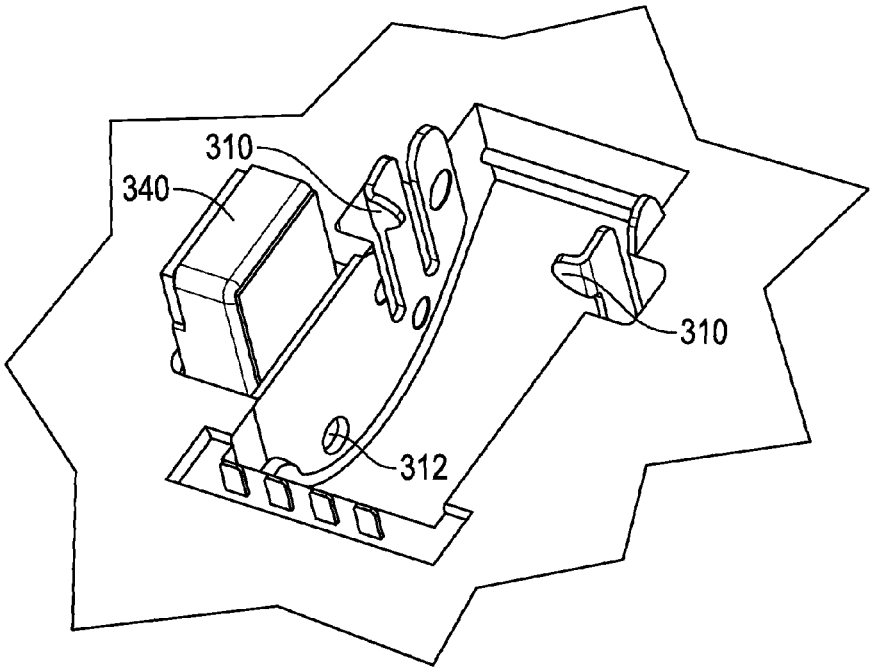
FIG. 3 illustrates a battery contact and a microphone for a hearing assistance device, according to various embodiments of the present subject matter.

FIG. 3 illustrates a battery contact 310 for a hearing assistance device, according to various embodiments of the present subject matter. The battery contact 310 creates a thin wall functioning as an acoustic barrier and acoustic channel or port 312 for a microphone 340. The space saved by such a design can be used to downsize the internal component footprint for the hearing assistance device, in various embodiments.

Figure 4A:
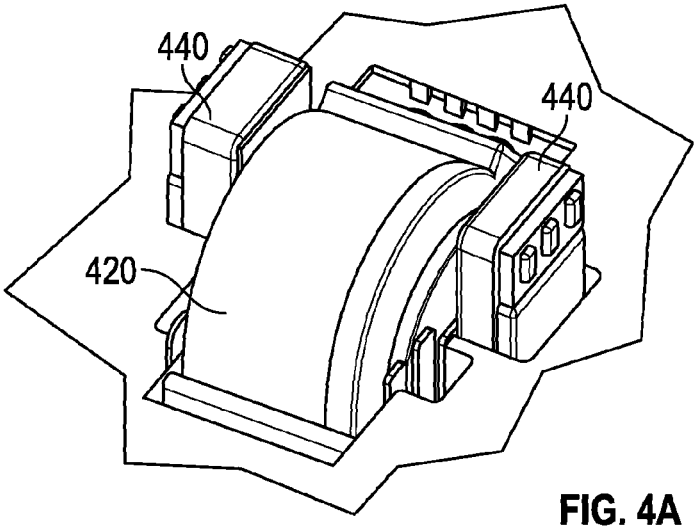
FIG. 4A illustrates an example of microphone positioning for a hearing assistance device, according to various embodiments of the present subject matter.
Figure 4B:
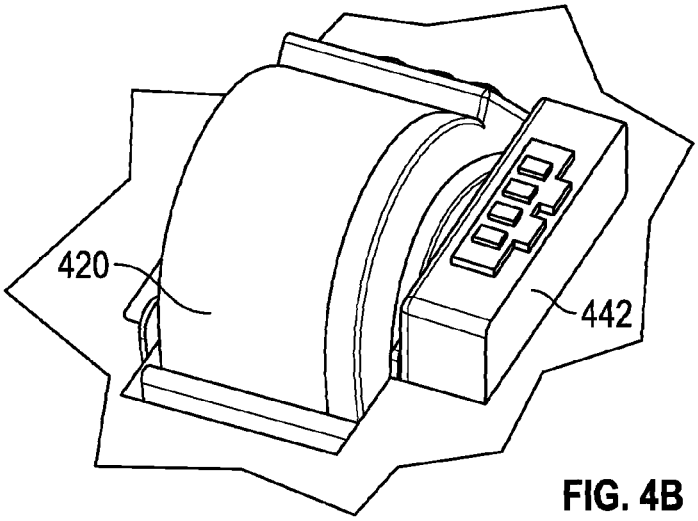
FIG. 4B illustrates another example of microphone positioning for the hearing assistance device.
Figure 4C:
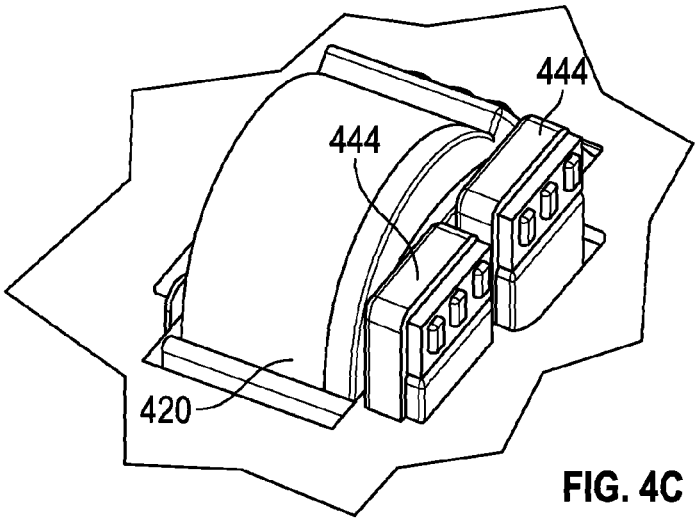
FIG. 4C illustrates yet another example of microphone positioning for the hearing assistance device.

FIGS. 4A-C illustrate microphone positioning examples for a hearing assistance device, according to various embodiments of the present subject matter. FIG. 4A shows a directional version with a battery door designed to provide for microphones 440 to locate on both sides of a battery 420, in an embodiment. FIG. 4B shows a conjoined microphone 442 located on one side of the battery 420, in one embodiment (e.g., when the hearing assistance device is of a CIC type). FIG. 4C shows two microphones 444 on one side of the battery 420, in one embodiment (e.g., when the hearing assistance device is of a CIC type). In various embodiments, the acoustic path to the microphone as discussed in this document is applied to each microphone in these examples.

Figure 5A:
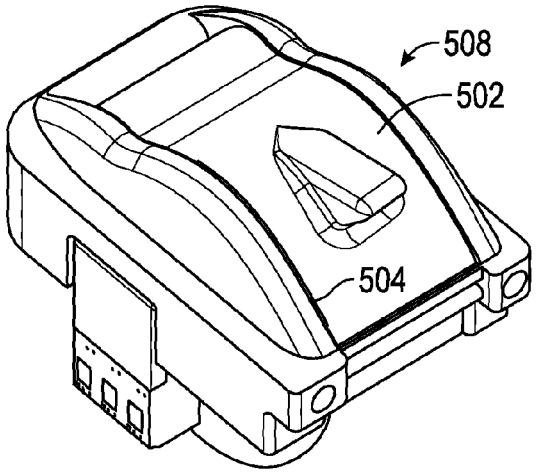
FIG. 5A illustrates portions of a snap-in faceplate module including a battery door for a hearing assistance device, according to various embodiments of the present subject matter.
Figure 5B:
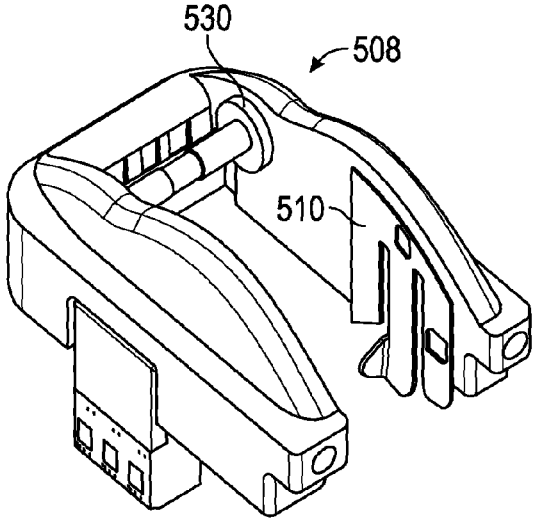
FIG. 5B illustrates portions of the snap-in faceplate module without showing the battery door.
Figure 5C:
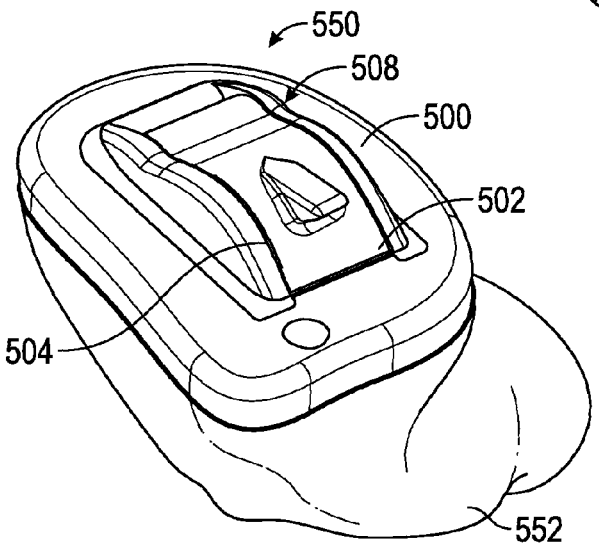
FIG. 5C illustrates the snap-in faceplate module snapped in a completely-in-the-canal (CIC) type hearing aid.

FIGS. 5A-C illustrate a snap-in faceplate module 508 including a battery door 502 for a hearing assistance device, according to various embodiments of the present subject matter. FIG. 5A shows the faceplate module 508 including the battery door 502 with a microphone slit 504 along a side of the battery door 502, in an embodiment. FIG. 5B shows the faceplate module 508 with a microphone contact 510 and centering bosses 530 to minimize drag during the opening and closing of the battery door 502, in various embodiments. FIG. 5C shows the faceplate module 508 snapped-in or otherwise attached to a faceplate 500 of a hearing assistance device 550. The snap-in faceplate module 508 includes most of components of the hearing assistance device 550, in various embodiments. In one embodiment, the snap-in faceplate module 508 includes all the components but the receiver (speaker) of the hearing assistance device 550. A smaller form factor is made possible by using a U-shaped design, in the depicted embodiments. The present subject matter includes a self-cleaning wiper arm to remove wax and debris, in various embodiments.

As an example for illustrative purposes only, the hearing assistance device 550 as shown in FIG. 5C as a CIC type hearing aid. In an embodiment, the hearing assistance device 550 is an invisible-in-the-canal (IIC) type hearing aid. In various embodiments, the hearing assistance device 550 may include any custom fit hearing aid or standard fit hearing aid, without departing from the scope of the present subject matter. In the illustrated embodiment, the hearing assistance device 550 includes a shell 553 that may be customized to mate with the wearer's hearing canal, and the faceplate 500 attached to the shell 552. In various embodiments, the shell 552 includes a large opening configured for interfacing with the faceplate 500. In various embodiments, this opening is of an irregular shape, requiring that the mating faceplate 500 be customized to fit to it. In various embodiments, a standard faceplate that is larger than the opening is fitted to the shell 552, and then modified to a custom shape to form the faceplate 500.

In various embodiments, components of the hearing assistance device 550 housed in the shell 552 include a microphone to receive a sound signal, a processing circuit to process the sound signal to produce an output sound signal, and a receiver (speaker) that converts the output sound signal to a sound audible to the wearer and transmits that sound to the wearer's ear canal. In various embodiments, the hearing assistance device 550 may include additional components. In various embodiments, the shell 552 houses circuitry including the microphone, processing circuitry, receiver, and optionally the additional components. In some embodiments, the faceplate 500 is configured to utilize various controls, such as adjusting dials and push-button switches.

According to various embodiments, the present subject matter includes a battery contact that creates an acoustic barrier and acoustic (microphone) port, and a vertical slit in the battery door creates an acoustic (microphone) opening. In various embodiments, the battery contact (e.g., the battery contact 110, 210, 310, or 510) and the battery door (e.g., the battery door 102 or 502) together create a non-linear acoustic path from the microphone opening on the battery door to the microphone. In various embodiments, this acoustic path includes at least one approximately 90 degree turn. In one embodiment, this acoustic path includes two approximately 90 degree turns. In various embodiments, this acoustic path is a torturous acoustic path. In various embodiments, the size and shape of this acoustic path is determined by the design of the battery door and the battery contact, including relative locations and shapes of various structural features of the battery door and the battery contact. In various embodiments, the acoustic path is formed in the hearing assistance device such that it is substantially or fully contained in the battery door and battery contact, does not increase a dimension of the battery door or the battery contact, does not add overall volume to the hearing assistance device, and is substantially invisible when the battery door is closed. These size and invisibility characteristics are examples of advantages provided by the present subject matter over existing designs which, for example, use a battery door to create an overhang and an acoustic path with a 90 degree turn on top of the battery door or faceplate. Such an acoustic path overlaps the faceplate and adds size or a bump to the battery door in the horizontal plane. In contrast, the present subject matter adds an acoustic path to existing components of the hearing assistance device substantially in a vertical plane by having the acoustic path substantially or fully contained in the existing components.

In various embodiments, the present subject matter provides for smaller hearing assistance devices, such as CIC or IIC devices, by eliminating additional microphone protective components such as microphone hood or wax guard. The saved space can be used for a thicker device shell, in an embodiment. The present subject matter allows for less frequent repairs due to microphone wax buildup, in various embodiments. In various embodiments, the present subject matter provides a solution to problems resulting from ingress of wax that is less labor intensive than manually carving out of an acoustic port.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), invisible-in-the-canal (IIC) or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:
- a microphone;
- a battery door including a microphone slit and an acoustic recess; and
- a battery contact including a microphone port,
- wherein the microphone slit, the acoustic recess, and the microphone port are configured to create an acoustic path to the microphone when the battery door is closed, the acoustic path including a first approximately 90 degree turn at the acoustic recess and a second approximately 90 degree turn at the microphone port, and the acoustic recess is positioned to collect wax when the hearing assistance device is being worn and allow the wax to be cleaned from the acoustic recess when the battery door is open.

2. The hearing assistance device of claim 1, wherein the slit is formed on a side of the battery door.

3. The hearing assistance device of claim 2, comprising a door axis around which to battery door rotates to open and close, and the slit is approximately perpendicular to the door axis.

4. The hearing assistance device of claim 3, comprising:
- a hinge pin along the door axis and coupled to the battery door; and
- centering bosses around the hinge pin to reduce drag during opening and closing of the battery door.

5. The hearing assistance device of claim 4, wherein the battery door comprises split draft sidewalls to facilitate swing of the battery door during the opening and closing of the battery door.

6. The hearing assistance device of claim 5, wherein hearing assistance device comprises a completely-in-the-canal (CIC) hearing aid.

7. A hearing assistance device, comprising:
- a shell;
- a microphone housed in the shell; and
- a faceplate attached to the shell, the faceplate including:
  - a battery door including a microphone opening and an acoustic recess, the acoustic recess positioned to be visible when the battery door is open and substantially invisible when the battery door is closed;
  - a battery contact configured to be an acoustic barrier and including a microphone port for the microphone; and a nonlinear acoustic path between the microphone opening and the microphone, the acoustic path formed by the battery door and the battery contact when the battery door is closed and including two approximately 90 degree turns to allow a sound to enter through the microphone opening, make an approximately 90 degree turn to go through the acoustic access, and make another approximately 90 degree turn at the microphone port to be received by the microphone.

8. The hearing assistance device of claim 7, wherein the microphone opening comprises a slit.

9. The hearing assistance device of claim 8, wherein the slit is along a side of the battery door.

10. The hearing assistance device of claim 7, wherein the acoustic path comprises a torturous acoustic path.

11. The hearing assistance device of claim 7, wherein the hearing assistance device is a hearing aid.

12. The hearing assistance device of claim 11, wherein the battery door comprises split draft sidewalls configured for facilitate opening and closing.

13. The hearing assistance device of claim 11, wherein the hearing aid comprises a hinge pin to which the battery door is coupled and centering bosses around the hinge pin.

14. The hearing assistance device of claim 11, wherein the hearing aid comprises a completely-in-the-canal (CIC) hearing aid.

15. The hearing assistance device of claim 14, wherein the hearing aid comprises an invisible-in-the-canal (IIC) hearing aid.

* * * * *